United States Patent [19]

Lorenzen, deceased et al.

[11] Patent Number: 4,867,029

[45] Date of Patent: Sep. 19, 1989

[54] STRINGED MUSICAL INSTRUMENT

[76] Inventors: Leslie J. Lorenzen, deceased, late of Tucson, Ariz.; Lawrence E. Lorenzen, executor, 15009 N. 33rd Pl., Phoenix, Ariz. 85032

[21] Appl. No.: 135,645

[22] Filed: Dec. 21, 1987

[51] Int. Cl.[4] ..... G10D 1/02

[52] U.S. Cl. ..... 84/277; 84/302

[58] Field of Search ..... 84/274–277, 84/297 R, 302, 309

[56] References Cited

U.S. PATENT DOCUMENTS

| | | | |
|---|---|---|---|
| 1,048,449 | 12/1912 | Francis | 84/277 X |
| 1,383,830 | 7/1921 | Leighton | 84/277 |
| 3,831,485 | 8/1974 | Dopera | 84/275 |
| 4,334,455 | 6/1982 | Beecher | 84/302 |

FOREIGN PATENT DOCUMENTS

| | | | |
|---|---|---|---|
| 431149 | 7/1926 | Fed. Rep. of Germany | 84/302 |

*Primary Examiner*—Lawrence R. Franklin
*Attorney, Agent, or Firm*—M. David Shapiro

[57] ABSTRACT

The invention comprises modification of a classical stringed instrument wherein an elevating block is used to make the string angle between the rearward portion of the strings with respect to the bridge of the instrument to be nearly the same as the angle between strings and bridge on the forward side of the bridge so that the bridge bisects the total included string angle. An associated modification of the position of the sound post from the classical position, which is to the rear of the right bridge foot, to a position just beneath the right bridge foot, is believed to enhance the efficiency of the sympathetic action of the back of the instrument with respect to the action of the belly of the instrument. The combination produces a much wider dynamic volume range and improved sensitivity and brillance with respect to that of an un-modified (classic) configuration.

6 Claims, 2 Drawing Sheets

STRINGED MUSICAL INSTRUMENT

FIELD OF THE INVENTION

The invention relates to a modification in the way a classical stringed musical instrument is constructed, the improvements being made for the purpose of adding volume range, brilliance and sensitivity to the instrument.

BACKGROUND OF THE INVENTION

Prior art classical stringed musical instruments in the violin family (refer to the "stick" drawing of FIG. 1) utilize a set of strings 10, 12, generally four in number, which are strung from tuning pins 14 in neck 16 of the instrument, over bridge 18 set on belly 20, back to tailpiece 22 which is held in place by tail block 24 and tail pin 42 of the instrument. Below the right bridge foot (not shown in FIG. 1, but see, FIG. 5 at reference numeral 26) a sound post 28 is placed, essentially between belly 20 and back 30 of the instrument, but slightly behind the right bridge foot, as shown. It is and has been believed that this location provides optimum coupling of sound vibrations from belly 20 to back 30 of the instrument and thereby provides for sympathetic vibration between the two plates when the strings are excited by a bow or fingers.

I have published a paper on the subject "The Violin Sound Post as a Phase Regulator," *Journal of the Violin Society of America,* Vol. VII, No. 4, pp. 122–133, Queens College Press, which describes in some detail the research I have done on this subject and the conclusions at which I have arrived.

A study of publications in this area indicate that string players and composers have contained to seek stringed instruments in the violin family which exhibit optimum dynamic range and sensitivity; a trend which began about three hundred years ago. Over the years, in order to get more brilliance and volume from the stringed instrument sections of the orchestra, standard pitch has been gradually raised more than two semitones by increasing tension in the strings and by introducing metal strings, both of which are now in common use. Also, violin bridges have been increased in height.

These factors, both separately and in concert, create much greater pressures which are applied to the belly of the instrument through the bridge. The increase in pitch, alone, has caused this pressure to increase by fifty percent or more over the period of development of the instruments. In older instruments, such as those of Stradivarius, Guarnerius and others of the Cremonese school, the belly and back thicknesses were considered to be optimum, and are still so considered and are commonly employed in modern instruments. But because of the factors identified above, much higher pressures are now applied to the belly and back plates than they were originally designed to accommodate. As a partial solution to this increase in pressure over the years, bass bars have been modified to much stronger, heavier construction. While this accomodates the increased pressure on the belly, it adds mass and stiffness to the instrument, thus adversely affecting the resonant characteristics thereof. This practice also tends to inhibit the free vibration of the belly.

In conventional prior art violin construction (see, FIG. 1), the vertical angles between bridge 18 and strings 10, 12, forward and to the rear of bridge 18, respectively, are asymetrical; the angle 38 forward of bridge 18 being somewhat larger than angle 36 on the rearward side of bridge 18. It is believed that because of the imbalance in angles 36, 38, sound post 28 must be optimally located slightly to the rear of the right bridge foot 26 so that it may properly function as a phase regulator between back 30 and belly 20; so that back plate 30 vibrates in synchronism with the major portion of belly 20 which is affixed to the bass bar (not shown in FIG. 1, but see, FIGS. 3, 4 and 5 at reference numeral 32). This optimal configuration has been determined empirically over centuries of experience with such stringed instruments and it has been shown that, given the conventional designs in use, such configuration provides for best communication of sound vibration from belly 20 to back plate 30.

However, the indirect path of such vibration communication required by the classic configuration is not efficient because of the offset (rearward) location of the sound post. Sound energy is thus forced to travel a somewhat torturous path to back plate 30.

SUMMARY OF THE INVENTION

These and other problems with prior art configurations are resolved by means of the instant invention in which the tailpiece is elevated such that the bridge bisects the included string angle over the bridge. I have empirically determined that with the sound post located directly beneath the right bridge foot, together with the use of symetrical angles from strings to bridge, a much improved dynamic volume range, brilliance and sensitivity is achieved by the instrument as modified by my invention.

Therefore, it is an object of the invention to provide a stringed instrument with an altered tailpiece for the purpose of equalizing the angles between the strings and the front and rear of the bridge, respectively.

It is another object of the invention to provide a sound post which resides directly under the right foot of the bridge of a stringed musical instrument.

It is still another object of the invention to provide both equal angles between the strings and the front and rear of the bridge, respectively, and to provide a sound post which resides directly under the right foot of the bridge of a stringed musical instrument.

These and other objects of the invention will be more readily understood upon study of the Detailed Description of the Preferred Embodiment of the Invention, infra, taken together with the drawings, in which:

FIG. 1 is a stylized (and exagerated) side view of a prior art violin, or the like;

Figure 1:
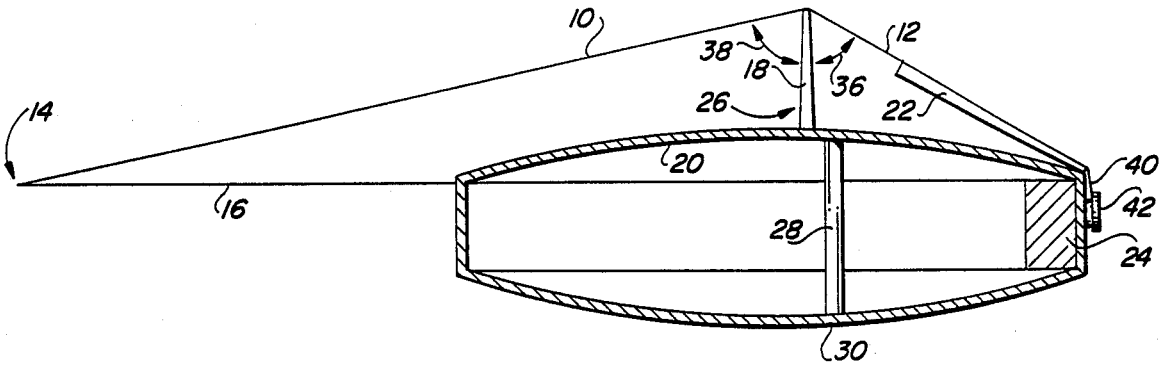
FIG. 1 (PRIOR ART)

DETAILED DESCRIPTION OF THE PREFERRED EMBODIMENT OF THE INVENTION (It should be noted that wherever in this specification like reference numerals are used they refer to like features of the invention. Wherever an alphabetic suffix is appended to such reference numerals, they indicate a variation of or a different version of the same reference numeral which does not carry such suffix.)

Figure 2:
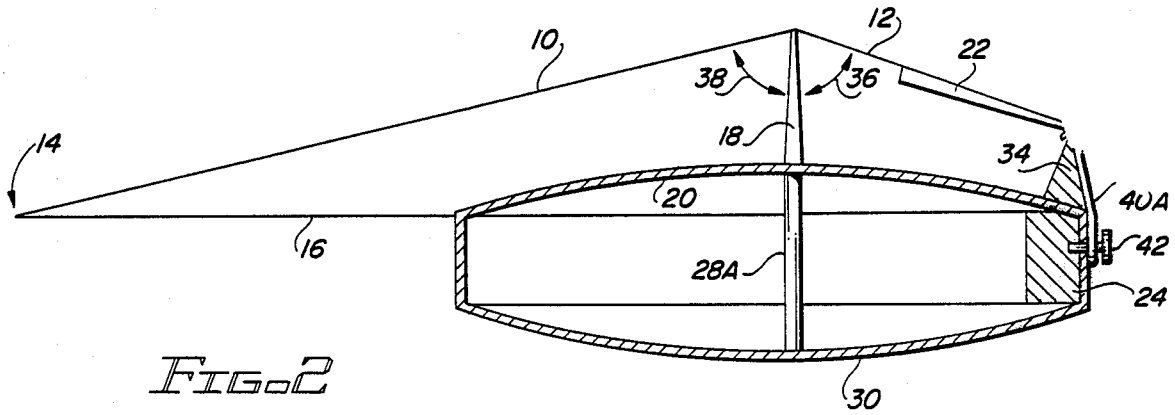
FIG. 2 is a modified version of FIG. 1 illustrating an improved configuration according to the invention.

Looking first to "stick" FIG. 2, it may be seen that spacer 34 has been inserted beneath the rearward end of tailpiece 22 in order to raise strings 12 to a point where angle 36 between strings 12 and bridge 18 is equal to angle 38 between strings 10 and bridge 18. Thus, the total included angle between strings 10 and strings 12 is bisected by bridge 18.

Figure 5:
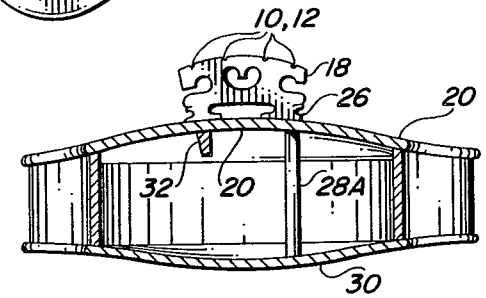
FIG. 5 is a cross-sectional view taken from 5—5 of FIG. 4.

It is believed that, because of the fact that the forces created by string tension are now directed straight down through bridge 18 to belly 20, below, it is possible to move sound post 28 (FIG. 1) to new position 28A, as shown in FIG. 2. The tensile forces in strings 10, 12, are equalized, in contrast to the tensile forces in these strings in FIG. 1 where a non-vertical component of the downward (resultant) string forces cause a differential tensile force between the two portions of strings 10,12. It is further believed that this vertical orientation of the resultant force in bridge 18 allows the stringed instrument builder to move sound post 28 to that position illustrated by sound post 28A of FIG. 2 directly under right foot 26 of bridge 18. (See, FIG. 5.)

To this point, the forces discussed are the static forces; that is, the forces which exist when the instrument is not being played. Dynamic force considerations are even more important. My experiments indicate that the left foot of bridge 18 (see, FIG. 5) is relatively fixed in position because it is rigidly supported by belly 20 of the instrument as backed up by bass bar 32, beneath it. (See, also, FIG. 5.) That means that most of the movement in response to excitation of the string(s) is transmitted to belly 20 (and to back 30, via sound post 28) through right foot 26 of bridge 18. Where, as in the prior art (FIG. 1), sound post 28 is located somewhat remote from right foot 26 of bridge 18, the resonant vibrations in belly 20 must be transmitted laterally through a portion of belly 20 before reaching the upper end of sound post 28. This means that the vibration linkage between right foot 26 of bridge 18 and back 30 of the instrument includes a relatively indirect path through the offset represented by the lateral distance from right foot 26 of bridge 18 to the upper end of sound post 28.

Because my invention alters the string to bridge angles 36, 38 to provide for bisection of the included string angle by the bridge (See, FIGS. 2 and 3) I believe that it allows for movement of the sound post 28A to a position directly between right foot 26 of bridge 18 and the lateral translation through belly 20 of prior art instruments is eliminated. My observations indicate that bridge 18 oscillates within its major plane in an arc about the left foot of bridge 18 contact point with belly 20 of the instrument when the instrument strings are excited because the left foot is relatively fixed in position by bass bar 32 beneath it; almost all of the dynamic energy is transmitted to belly 20 via right foot 26 of bridge 18. It is my view that the energy concentration in right foot 26 of bridge 18 is not efficiently transmitted to back plate 30 of the instrument because of the offset path required in prior art instruments. The new location of sound post 28A provides for a more direct and efficient energy path from right foot 26 of bridge 18 to back plate 30. It is believed that the more efficient configuration of the invention also requires less excitation of the strings for a given audio output level.

Figure 6:
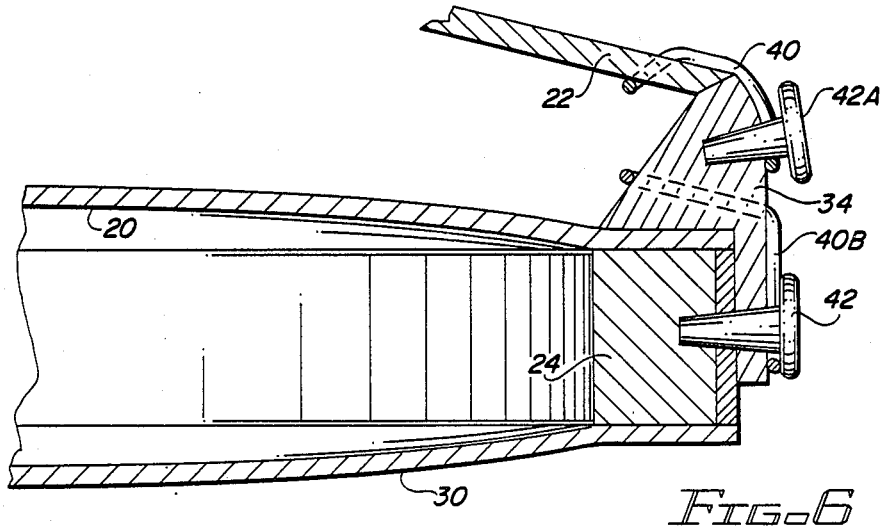
FIG. 6 is a partial side view of the rear of a violin illustrative of a separate block and tail piece implementation of the invention.

It may be seen from FIG. 6 that elevating element 34 may be applied to an existing instrument in the form of a spacer block 34 which is tailored to the shape of belly 20 of the instrument in the area of contact with belly 20, thereof, and to tail piece 22 of the existing instrument at the upper end juncture between block 34 and tail piece 22. It may then be held in place with a closed loop of suitable material (gut, nylon or the like) 40B which is then looped over tail pin 42. Another tail pin 42A is fabricated to fit into the rear side of block 34 so that loop 40, normally emanating from tailpiece 22 and connected to tail pin 42, may now be looped over new second tail pin 42A on the rearward side of block 34.

Figure 3:
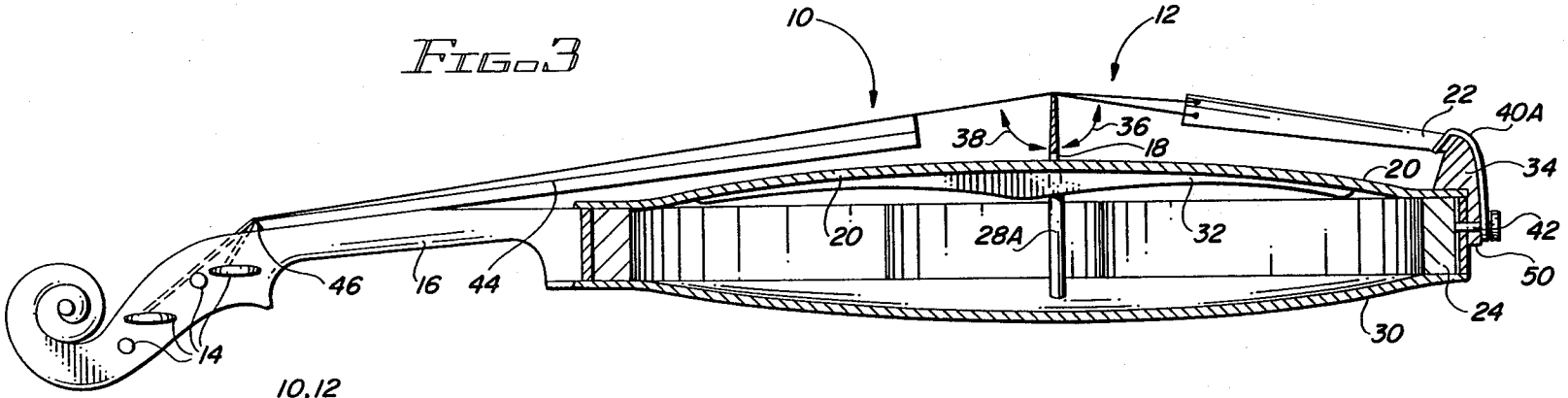
FIG. 3 is a more classical illustration, in a side view with the left side of the instrument omitted for clarity, of a violin equipped with the modified tailpiece and sound post according to the instant invention.

Observation of FIG. 3 will show that where the modification suggested by the instant invention is to be made as a part of a newly fabricated instrument, elevating block 34 may be fabricated as an integral part of the tailpiece 22; the lower end of combination block 34 and tail piece 22 being fitted to belly 20 of the instrument. The conventional loop linkage of the prior art instruments may be elongated 40A to reach down the back side of the elevating member 34 to the prior art anchor pin 42 or could be captured to block 34 at a lower point (not shown).

Figure 4:
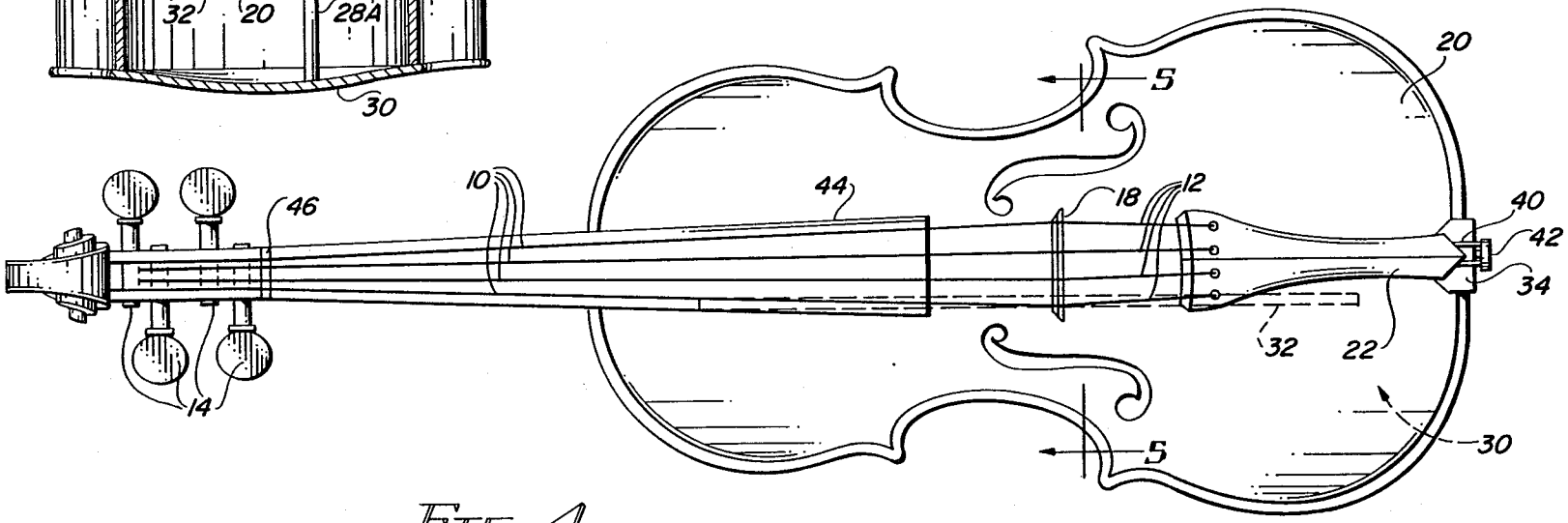
FIG. 4 is a top view of the violin of FIG. 3.

A preferred embodiment of the invention is illustrated in FIG. 3. While a violin is used for illustrative purposes, the invention is not intended to be so limited. It is believed that the improved configuration may be applicable to and effective upon any stringed instrument, such as a viola, a violoncello (cello), a bass viol (double bass), etc. FIG. 3 is a side view of a violin with the near side opened up for clarity of the disclosure of the invention. It will be useful to observe FIG. 4 (a top view of the violin of FIG. 3) along with Figure 3 to more fully understand this embodiment of the invention.

A plurality of strings 10, 12 (four in the classical configuration), are stretched across bridge 18. At their forward ends, they extend over fingerboard 44, pass over nut 46 and are fastened individually in a well known way to tuning pegs 14. At the rearward ends, they are fastened to tailpiece 22, again, in the classical way. As tension is applied to this system of strings by tuning pegs 14, bridge 18 is urged by string tension to compress against belly 20 of the instrument. This compressive force, and the friction induced thereby at the juncture of strings 10, 12 and bridge 18, an at the juncture of bridge 18 with belly 20, work to keep bridge 18 in position, just as in prior art configurations. However, as before stated, the forces applied to bridge 18 are aligned with bridge 18 and there is no out-of-line component of the compressive force which must be accomodated by the strings.

Returning attention to tailpiece 22, note that it is secured by a closed loop of gut, nylon or similar material 40A to tail pin 42. Tail pin 42 is slightly tapered and engages matching tapered holes in anchor flange 50 of elevating block 34 and tail block 24 of the violin, by means of a press fit.

As before stated, elevating block 34 is tailored in height to the requirement for equal angles at 36, 38. Of course, the actual dimensions of block 34 may vary from one instrument to the next to attain optimum results.

Sound post 28A is dimensioned to be a snug fit (as in prior art instruments) between belly 20 and back 30 of the violin, prior to application of string forces. It is positioned directly below the right foot of bridge 18 between belly 20 and back 30. Application of string tension applies a compressive force to sound post 28A which acts to hold it tightly in position.

Bass bar 32 under the left foot of bridge 18 is not affected in any way, either in position or in function, by the modifications administered to the violin.

In empirical testing, it has been shown that the configuration of FIGS. 2 and 3 is very effective. In listening tests, university level educators in the musical arts have been very impressed with the improved dynamic range of the output audio volume of the new configuration. It is possible to hold the quality of the music produced over a much wider volume range. Brilliance and sensitivity of the modified instrument are also markedly improved.

While the invention has been particularly shown and described herein with reference to a preferred embodiment thereof, it will be understood by those skilled in the art that various other modifications and changes may be made to the present invention from the principles of the invention as herein described without departing from the spirit and scope as encompassed in the accompanying claims. Therefore, it is intended in the appended claims to cover all such equivalent variations which may come within the scope of the invention as described.

What is claimed is:

1. In a classical stringed musical instrument having a plurality of strings, a like plurality of tuning pegs, a tailpiece, a bridge, a belly, a back and a sound post, wherein the strings are stretched over the bridge between the tailpiece and the tuning pegs, the bridge is supported on the belly and the sound post is located between the belly and the back, the improvement comprising the steps of:

positioning the sound post directly below a right foot of the bridge; and elevating a rearward end of the tailpiece so that an included angle between a portion of the plurality of strings forward of the bridge and a portion of the plurality of strings to the rear of the bridge is bisected by the bridge, said elevating step being accomplished by means of a spacer block being placed under a rearward end of the tailpiece.

2. In a classical stringed musical instrument having a plurality of strings, a like plurality of tuning pegs, a tailpiece, a bridge, a belly, a back and a sound post, wherein the strings are stretched over the bridge between the tailpiece and the tuning pegs, the bridge is supported on the belly and the sound post is located between the belly and the back, the improvement comprising the steps of:

positioning the sound post directly below a right foot of the bridge; and elevating a rearward end of the tailpiece so that an included angle between a portion of the plurality of strings forward of the bridge and a portion of the-plurality of strings to the rear of the bridge is bisected by the bridge, said elevating step being accomplished by means of a tail piece incorporating an integral spacer block therein.

3. In a classical stringed musical instrument having a plurality of strings, a like plurality of tuning pegs, a tailpiece, a bridge, a belly, a back and a sound post, wherein the strings are stretched over the bridge between the tailpiece and the tuning pegs, the bridge is supported on the belly and the sound post is located between the belly and the back, the improvement comprising:

means for elevating a portion of the plurality of strings to the rear of the bridge, said means for elevating being located between a rear end of the tailpiece and a rear end of the belly of the musical instrument, said elevating means being of a height which causes an included angle between a forward portion and a rearward portion of the plurality of strings to be essentially bisected by the bridge when the bridge is in a position essentially perpendicular to the belly of the instruments; and wherein the sound post is located directly beneath the right foot of the bridge.

4. The classical stringed musical instrument according to claim 3 wherein the sound post is located directly beneath a right foot of the bridge.

5. The classical stringed musical instrument according to claim 3 wherein said elevating means is an integral part of a modified tailpiece.

6. The classical stringed musical instrument according to claim 3 wherein said elevating means is a separate block.

* * * * *